US009324466B2

(12) United States Patent
Helle et al.

(10) Patent No.: US 9,324,466 B2
(45) Date of Patent: Apr. 26, 2016

(54) TRANSPORTATION CONTAINER

(71) Applicant: Medi-Physics Inc., Princeton, NJ (US)

(72) Inventors: Kevin Helle, Bartlett, IL (US); Jay Reed, Elk Grove, IL (US); Robert F Chisholm, Marlborough, MA (US)

(73) Assignee: MEDI-PHYSICS, INC., Princeton, NJ (US)

( * ) Notice: Subject to any disclaimer, the term of this patent is extended or adjusted under 35 U.S.C. 154(b) by 0 days.

(21) Appl. No.: 14/651,447

(22) PCT Filed: Dec. 26, 2013

(86) PCT No.: PCT/US2013/077840

§ 371 (c)(1),
(2) Date: Jun. 11, 2015

(87) PCT Pub. No.: WO2014/105971

PCT Pub. Date: Jul. 3, 2014

(65) Prior Publication Data

US 2015/0325321 A1 Nov. 12, 2015

Related U.S. Application Data

(60) Provisional application No. 61/746,195, filed on Dec. 27, 2012.

(51) Int. Cl.
*G21F 5/015* (2006.01)
*G21F 5/12* (2006.01)

(52) U.S. Cl.
CPC . *G21F 5/015* (2013.01); *G21F 5/12* (2013.01)

(58) Field of Classification Search
USPC ..... 250/506.1, 505.1
See application file for complete search history.

(56) References Cited

U.S. PATENT DOCUMENTS

| | | | | |
|---|---|---|---|---|
| 3,531,644 | A | 9/1970 | Koster | |
| 4,923,088 | A | 5/1990 | Tanaka et al. | |
| 5,274,239 | A | 12/1993 | Lanes et al. | |
| 7,842,023 | B2 | 11/2010 | Chinol et al. | |
| 8,269,201 | B2 | 9/2012 | Fago et al. | |
| 2005/0234424 | A1 * | 10/2005 | Besing | A61M 5/1785 604/500 |
| 2010/0019174 | A1 | 1/2010 | Helle et al. | |

OTHER PUBLICATIONS

International Search Report and Written Opinion from corresponding PCT application No. PCT/US2013/077840 dated May 22, 2014; 10 pages.

* cited by examiner

*Primary Examiner* — Kiet T Nguyen

(57) ABSTRACT

The present invention provides a radiation-shielding container for a radiopharmaceutical that allows or a product fluid to be dispensed from a base component thereof.

22 Claims, 6 Drawing Sheets

TRANSPORTATION CONTAINER

This application is a filing under 35 U.S.C. 371 of international application number PCT/US2013/077840, filed Dec. 26, 2013, which claims priority to a U.S. application No. 61/746195, filed Dec. 27, 2012, the entire disclosure of each of which is hereby incorporated by reference.

FIELD OF THE INVENTION

The present invention relates to the field of containers. More specifically, the present invention is directed to a shielded container for a radiopharmaceutical.

BACKGROUND OF THE INVENTION

Radio-pharmaceuticals are typically packaged in a standard way to reduce exposure to the end-user of the product. Most of these types of pharmaceuticals have short half-lives, so radioactive content can be extremely high to the operators during manufacturing and handling of these products. Packaging containers consists of several components, with the main component being lead. Lead has a very high density and provides excellent shielding characteristics for both gamma and beta emitting radio-pharmaceuticals. Lead is also very heavy and thus contributes to ergonomically related stress during manufacturing, assembly, and handling.

With reference to FIG. 1, a radio-pharmaceutical container 10 of the prior art typically includes an outer shell 12 that is typically formed from plastic and is both durable and cleanable. The outer shell 12 is durable to meet the requirements of the Department of Transportation (DOT). The outer shell 12 must contain and protect the inner contents of the package 10 during shipping and use of the product. The outer shell 12 is cleanable so that any radioactive contamination can be washed off of the surface. Radioactive contamination is a possibility due to the nature of the contents and the environment where the containers are used. The outer shell 12 typically has a label containing all of the product information such as; product name, manufacturing date, volume, specific activity, etc. The outer shell 12 is usually and injection molded component that contains sub-parts 12*a* and 12*b* that are assembled into a lower and upper assembly.

Container 10 further includes an inner shell 14 that fits within the outer shell 12. The inner shell 12 is typically manufactured from lead with a small percentage of antimony. The inner shell is designed to provide shielding of the radioactive contents of the container 10. The inner shell 14 is usually poured from molten lead into a negative void, or form. The inner shell 14 contains sub-parts 14*a* and 14*b* that are assembled into a cap 16 and base 18 by mating with outer shell sup-parts 12*a* and 12*b*, respectively.

The prior art container accommodates a product container 15, typically a vial, that is the primary holder of the product. It can be made of plastic or glass and can be sterile or non-sterile. Container 15 typically includes a pierceable septum across an open end, or mouth, thereof. Septum 17 allows a needle or cannula to pierce the septum and extend to the product fluid contained within container 15 for withdrawal. The product container 15 may be kept in the shipping container 10 during use to reduce exposure to the end-user.

Additionally, there may be an absorbent material placed in the container to absorb fluid if the product container is breached during shipment or use. There may be a cushioning material, such as a sponge, to protect the product container from shock during shipment or use. There may also be an inner sleeve that can be between an inner surface and the product container to segregate the product container from the lead of the radiation shield.

The outer shell 12 and inner shell 14 are fully formed by a mating cap 16 and base 18. The base 18 typically defines the container cavity 20 into which the vial 15 is placed. When the cap 16 and base 20 are mated, the cavity 20 is sealed and surrounded by the lead shielding material of inner shell 14*a* and 14*b*. After the drug product is manufactured, the product container, typically a vial, is placed into the container cavity 20 and the cap 16 is secured to the base 20. During end use of the product fluid in the vial 15, the cap 16 is removed and a syringe is used to pierce the septum 17 of the vial 15 for extraction of the desired amount of product fluid. Manipulation of the fluid requires the cap 16 to be removed, thus providing the path for radiation exposure to a user.

These packaging containers provide shielding from the activity of the radiopharmaceutical within during shipment and storage. However, once the container is opened, there can be exposure to both lead as well as to radiation shining out through the open storage cavity of the inner shell. Additionally, once the container is opened, the product container 15 is loose, or non-captive. Moreover, in order to visually check the amount of radioactive fluid remaining in the vial 15, an operator must lift the vial 15 out from cavity 20, further exposing the operator to activity shining out from the vial.

The art lacks a shielded container for a radiopharmaceutical which reduces operator exposure to the radiopharmaceutical during extraction of the radiopharmaceutical product and extraction of the product vial.

DETAILED DESCRIPTION OF THE PREFERRED EMBODIMENT

Figure 1:
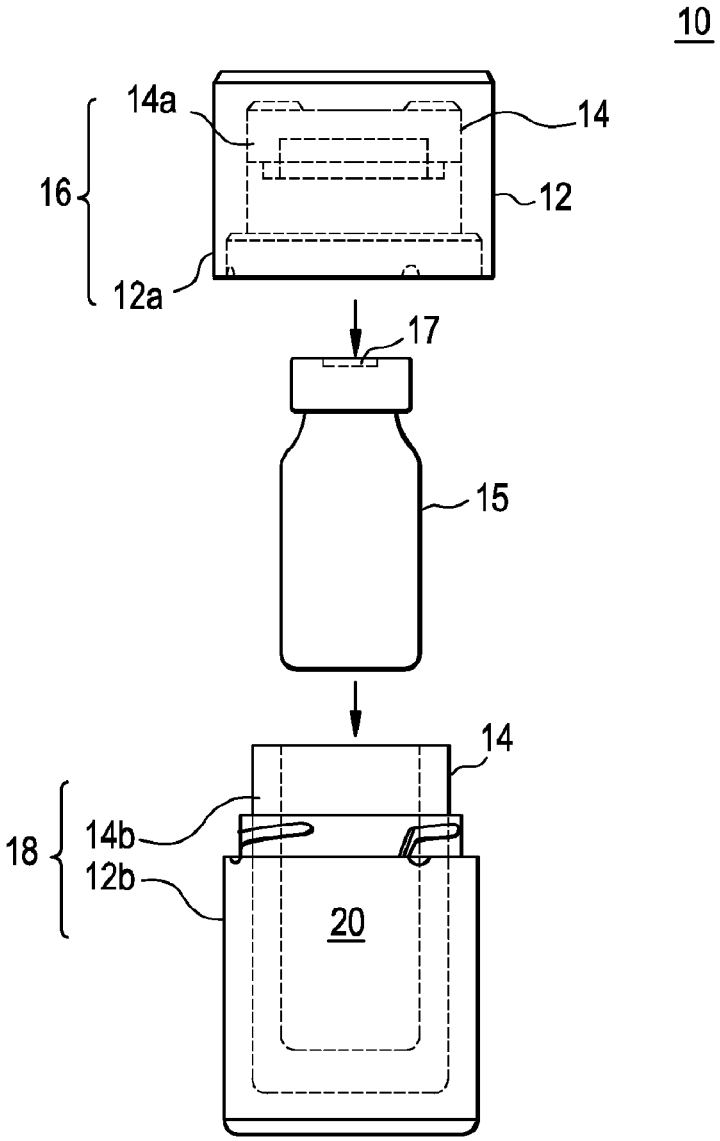
FIG. 1 PRIOR ART
FIG. 1 depicts a radiation-shielding container of the prior art.

The present invention provides a radiation-shielding transportation and storage container for a radiopharmaceutical which provides protection to the clinician, or operator, who must extract the fluid from the vial within the container. The present invention may be assembled to provide a sealed, radiation-shielded, lead-safe, container useful for storage, transportation, and extraction of the product fluid. The present invention is intended to substantially minimize or eliminate lead exposure to the operator, reduce whole-body and extremity exposure for the clinician, and safely and stably hold the product vial therein.

One embodiment of the present invention provides a radiation-shielding container for storing and transporting a radiopharmaceutical. The container includes an outer cap, a base, and an inner cap. The inner cap includes an inner cap shield cylindrical portion defining an open end and an inner cap aperture and an opposed planar wall. The inner cap shield includes an outer surface and an inner surface whereby the inner surface helps define a cavity and the inner shield defines at least one aperture therethrough. When assembled the at least one aperture is in fluid communication with the cavity. The base includes an elongate cylindrical base shield having an open end defining a base aperture and an opposed closed end. The base shield includes an outer base shield surface and an inner base shield surface whereby the inner base shield surface defines a lower base cavity in fluid communication with the at least one aperture through the inner cap shield.

The container of the present invention is contemplated to include a removable base portion which allows the vial to be dropped from the cavity, away from the inner cap shield, so that the clinician may view the amount of fluid remaining in the vial. The present invention further contemplates providing a cylindrical inner shield having a longitudinal gap, the gap allowing the clinician to see the fluid within the vial, while the shield offers protection to the clinician from exposure to the activity of the fluid. The present invention further contemplates that the provision of a removable base portion allows for the inner shield to be formed as a unitary component with the remainder of the base shield. The container may further includes a ferromagnetic plug positioned adjacent to an outer surface of the shield of one of the cap shield and the base shield to assist in automated pick and placement of the container.

The container of the present invention reduces the ergonomic and repetitive stress associated to the manufacture and handling of the product as the removable cap for product withdrawal does not include a full radiation-shielding liner as with the caps of the prior art. The product container of the present invention can weigh one pound or more, and a typical manufacturing lot may contain several hundred to several thousand product containers. The size of the container of the present invention is such that single hand manipulation of the product container is common; however, the size is several inches in diameter and ergonomically challenging when handling production volumes. The container of the present invention will minimize the operator whole body and extremity exposure incurred during manufacturing and handling of the product. In addition, the container of the present invention will reduce the ergonomic and repetitive stress associated with the manufacturing and handling of the product.

A product vial may be placed within the cavity of the container of the present invention so that the end-user will receive a needle-accessible vial in the container. The container includes a pierceable septum or stopper. The cooperating shields of the inner cap and base will substantially surround the vial so that only the inner cap aperture(s), or passageway(s), provide a shine path for the activity out of the product cavity. However, when the outer cap is connected to the base, the shielding substrate of the outer cap will be in overlying shielding registry with the inner cap passageways, thus completing the shielding of the activity within the product cavity. With the product vial inserted into the product cavity, the inner cap may then be connected to the base such that the septum of the vial is thus placed in underlying registry with the passeway(s) of the inner cap. As the passageway(s) of the inner cap are desirably formed to conform to the outer dimensions of a withdrawal or vent needle inserted therethrough, as appropriate, the present invention will provide minimal exposure of a clinician to the activity of the product fluid within the cavity, particularly as compared to the container of the prior art, when inserting the needles through the inner cap.

Figure 2:
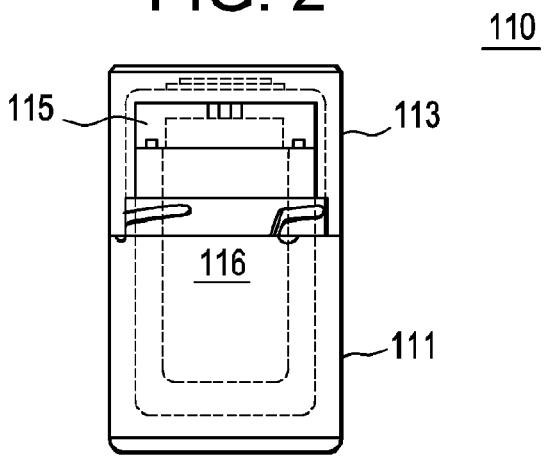
FIG. 2 depicts a container of the present invention, showing internal components in phantom lines.
Figure 3:
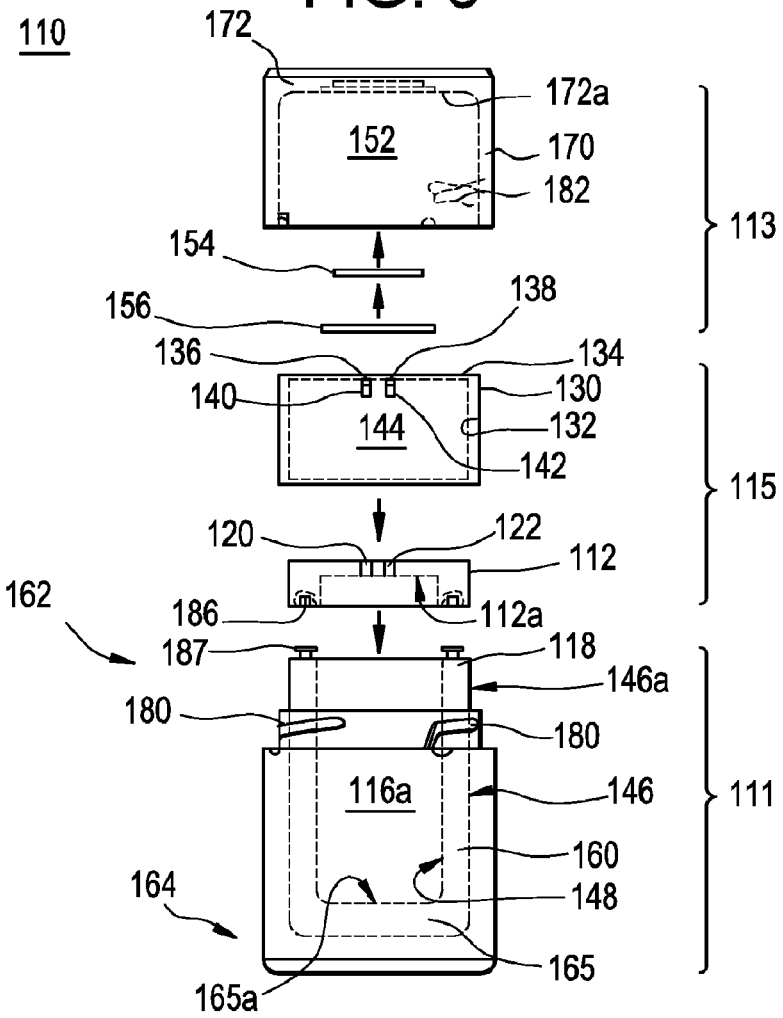
FIG. 3 depicts an exploded view of the container of FIG. 2.
Figure 4:
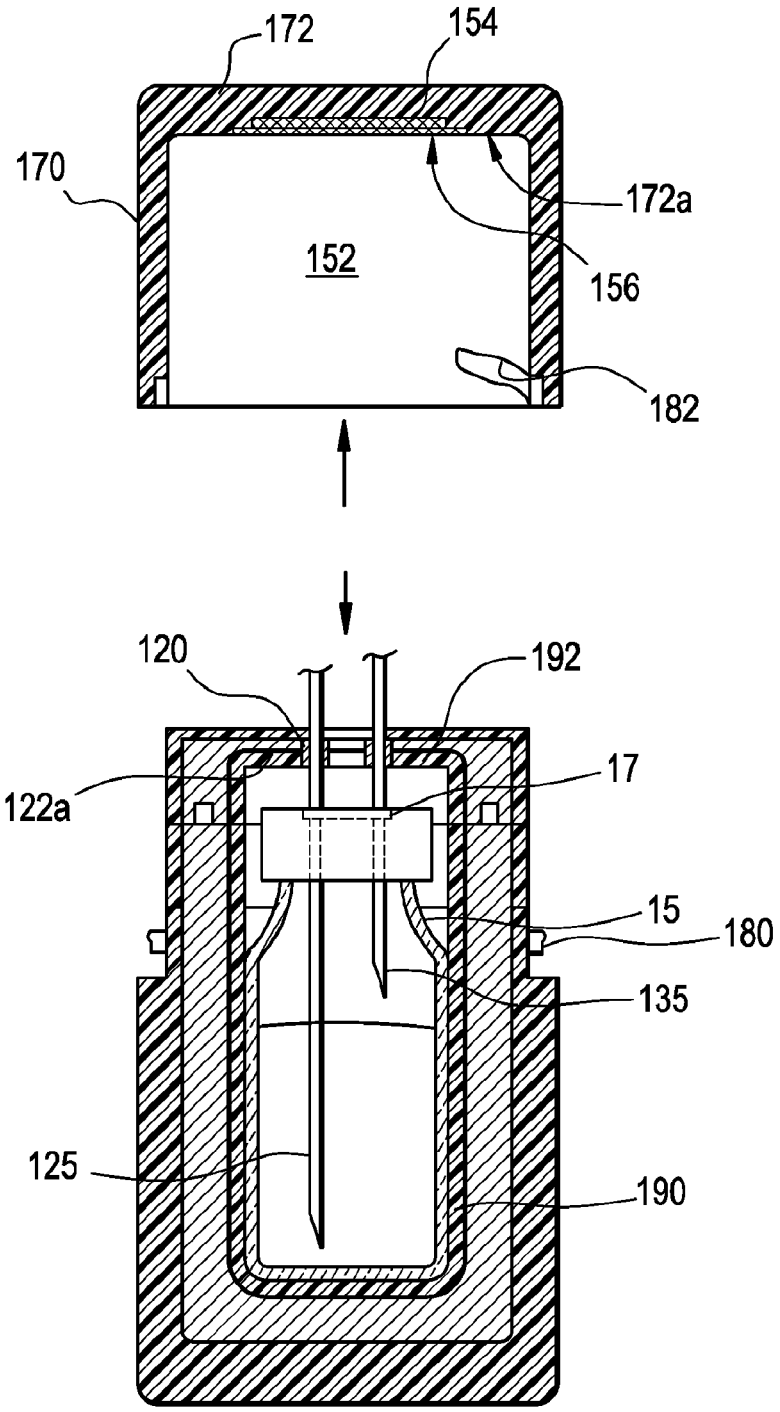
FIG. 4 is a cross-sectional view of the container of FIG. 2 showing a withdrawal needle and a vent needle inserted through the inner cap and into a product vial held therein.

As shown in FIGS. 2-4, in one embodiment the present invention provides a radiation-shielding container 110 including a base 111, an outer cap 113, and an inner cap 115. Outer cap 113 includes an outer cap body 150 defining an outer cap cavity 152 and a shielding substrate 154 formed from a radiation-shielding material. Outer cap body 150 is desirably formed from a polymeric material. Base 111 and inner cap 115 are removably connectable to each other. Base 111 and inner cap 115 further include cooperating radiation shields members 112 and 118 which define a product cavity 116 therebetween for receiving a product container 15 therein. The radiation shield 112 of the inner cap 115 defines at least one elongate aperture, or passageway, 120 therethrough. While the passageway(s) are shown to extend parallel to the longitudinal axis of the container, the present invention contemplates that the passageways may extend obliquely through the inner cap shield, and while the obliquely-oriented passageways may still be in effective registry with the shielding substrate of the outer cap, such passageway(s) could necessitate providing additional shielding material in the outer cap. That is, outer cap 113 is contemplated to support a shielding layer that extends in overlying shielding registry with the apertures extending through radiation shield 112 so as to shield the shine path thus presented. Base 111 and outer cap 113 are also removably connectable to each other such that when inner cap 115 is connected to base 115, inner cap 115 will be contained within outer cap cavity 152 and the at least one passageway of the inner cap extends in fluid communication through the radiation shield of the inner cap between the product cavity and outer cap cavity 152.

Referring still to FIGS. 2-4, outer cap 113 includes a cylindrical wall 170 perimetrically bounding and depending from a planar end wall 172 so as to define cavity 152. Walls 170 and 172 are desirably formed from a polymeric material. Shielding substrate 154 may be adhered to an inner surface 172*a* of wall 172 by a bonding layer 156, such as a polymeric tape or other substrate which bonds to surface 172*a* in a manner to hold shielding substrate 154 in place. Inner surface 172*a* may further define a recess 175 into which shielding substrate 154 is supported Shielding substrate 154, being formed from a radiation-shielding material, is held in overlying shielding registry with the aperture(s) extending through inner cap 115 when the outer cap and the inner cap are both connected to the base. The present invention contemplates that shielding substrate 154 is coextensive with any shine path extending through the apertures of inner cap 115. If necessary, the present invention contemplates that shielding substrate may extend along the cylindrical wall 170 if necessary to block the shine path from inner cap 115 extending through the polyemeric material of outer cap 113 unattenuated. Alternatively, the present invention contemplates for all embodiments that the shielding substrate 154 or its associated bonding layer 156 comes to rest on inner cap 115 so as to close off apertures 136 and 138, i.e., there need not be a gap therebetween providing communication between cavity 116 and cavity 152. Apertures 136 and 138 will are used herein to refer to the passageways formed through inner cap 115 for all embodiments, while apertures 120 may specifically refer to the passageway(s) through the inner cap shield. The dimensions of substrate 154 will thus be dictated by the material used, the orientation of the apertures through inner cap 115, and the amount of shielding desired given the activity of the product to be held within the container.

Container 110 provides an inner cap shield 112 spanning the mouth 114 of the lower cavity 116*a* of the base shield 118. The inner cap shield 112 and base shield 118 provide shielding material which defines the base cavity 116. The inner cap shield 112 further provides a first aperture 120 therethrough which allow the insertion of a withdrawal cannula, or needle, 125 therethrough to pierce the septum 17 of an inserted vial 15. The inner cap 112 may also provide a second aperture 122 therethrough which will allow the insertion of a second cannula, or needle, 135 therethrough to pierce the septum 17 of a vial 15 held in cavity 116 and assist in fluid withdrawal as is known in the art. Desirably, any aperture formed through the inner cap is sized and shaped to substantially conform to the cannula or needle inserted therethrough.

Container 110 further includes an inner cap cover 130 having a cylindrical wall 132 perimetrically bounding and descending from a planar end wall 134. Planar end wall 134 defines first and second apertures 136 and 138 therethrough which are positioned in overlying shielding registry with apertures 120 and 122 of inner cap shield 112. End wall 134 desirably also includes depending cylindrical walls 140 and 142 which further define apertures 136 and 138 and which are sized and shaped to provide a lining along apertures 120 and 122 so that the cannulas inserted therethrough do not contact the shielding material of cap shield 112. Cylindrical wall 132 further defines inner cover cavity 144 which receives cap shield 112. The present invention contemplates that cylindrical wall 132 extends along a portion 146*a* of the outer surface 146 of base shield 118.

Base 111 includes an elongate cylindrical base shield 118 having a cylindrical wall 160 extending between opposed first and second ends 162 and 164, respectively. First end of wall 160 defines open mouth 114 in fluid communication with lower cavity 116*a* opposite a substantially planar wall 165 at second end 164. Base shield 118 includes an outer base shield surface 146 and an inner base shield surface 148 about lower cavity 116*a*. A polymeric base covering 145 is provided about outer surface 146 below portion 146*a* although it is further contemplated that covering 145 may extend the full length of surface 146 is if wall 132 is modified to so accommodate. The present invention further contemplates surface 148 further supports a thin cylindrical polymeric liner 190 thereon to extend between shield 118 and a container 15 within cavity 116. Liner 190 desirably also includes a planar portion 190*a* covering the inner surface 165*a* of planar wall 165. Similarly, a polymeric liner 192 may also be positioned on an interior surface 112*a* of radiation shield 112 of the inner cap 115 such that no radiation-shielding material of the inner cap is exposed to the product container 15.

Alternatively, the present invention contemplates that a first polymeric liner may be provided completely about the radiation shield of the base and a second polymeric liner may be provided completely about the radiation shield of the inner cap such that no radiation-shielding material of the inner cap or the base is exposed when said inner cap is removeably connected to said base. In such an embodiment, it will be desirable to provide radial-overlap of the cylindrical walls of the inner cap shield and base shield.

Additionally, the present invention contemplates that the outer cap body 113 and base 111 include cooperating members to removably connect the outer cap body to the base. The cooperating members may take the form of, by way of illustration and not of limitation, helical threads or cooperating bayonet connectors as represented by parts 180 and 182 in FIG. 3. Inner cap 115 and base 111 may also include cooperating elements to removeably connect the inner cap to the base. The cooperating elements may take the form of, by way of illustration and not of limitation, cooperating helical threads or cooperating deflectable detents, or the cooperating slot and pin 184 and 186 depicted in FIG. 3.

The present invention may further provide a compressible cushion within the product cavity further protect the vial during storage and transportation. The cushion may be sized to accommodate a vial of a particular size by deflecting just enough so that the vial is held captive between the cushion and the inner cap, further stabilizing the vial within the product cavity so as to minimize breakage of the vial. Additionally, as the vial need not be removed from the product cavity of the container of the present invention in order to withdraw the fluid contents therefrom, the present invention may eliminate the need to provide labels to both the vial and to the transportation container. A label on the transportation container may be sufficient for the clinician.

Figure 5:
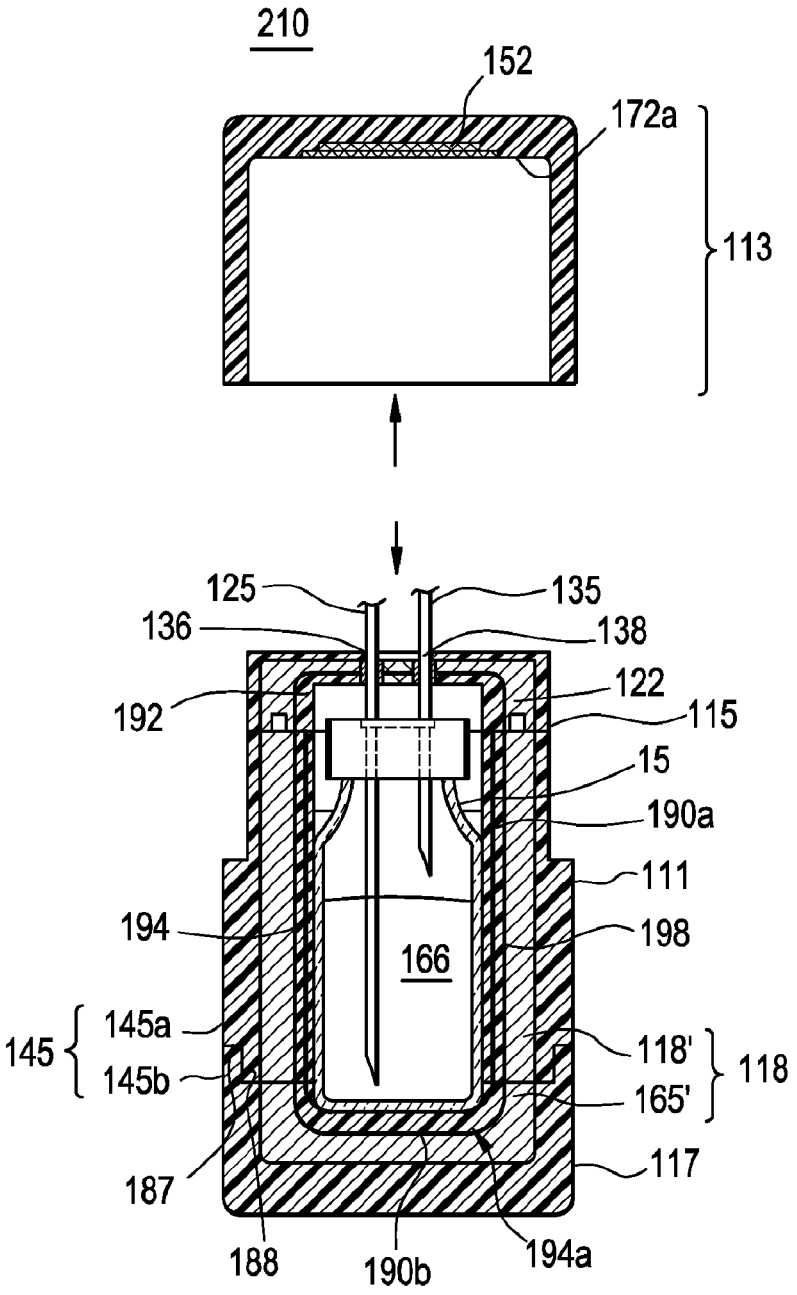
FIG. 5 depicts a cross-sectional view of radiation-shielding container of the present invention having a removable base portion.
Figure 6:
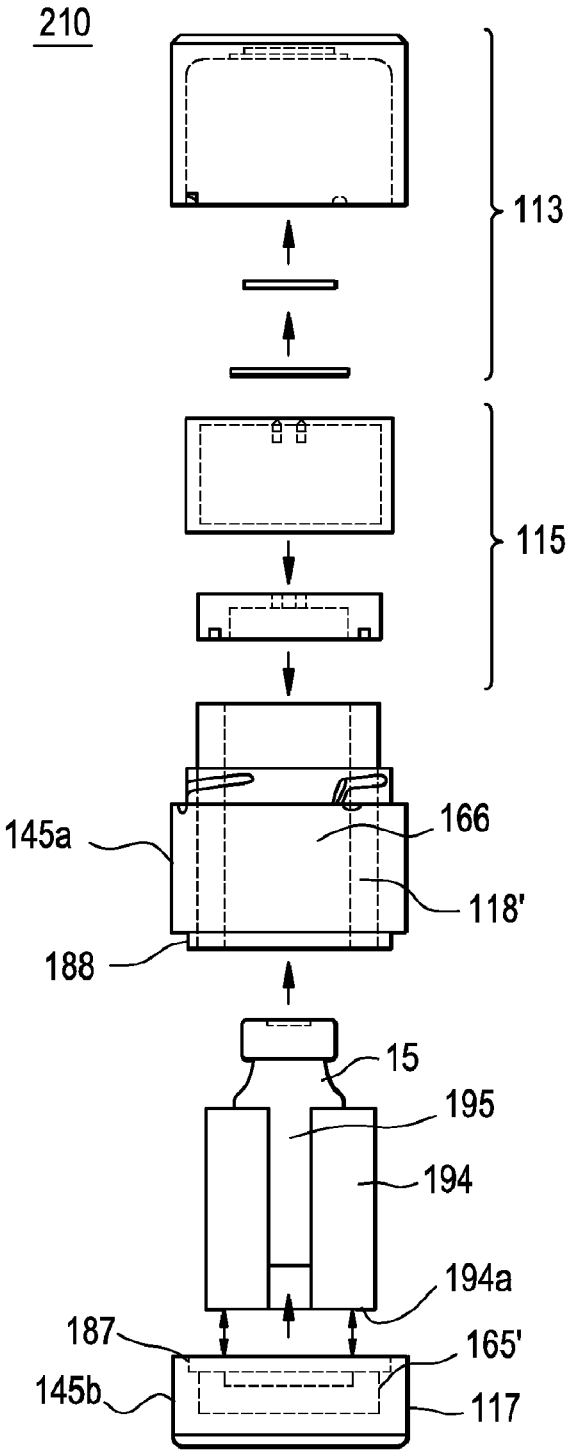
FIG. 6 depicts an exploded view of container of FIG. 5.

As shown in FIGS. 5 and 6, the present invention further contemplates that the base of the container of the present invention may also include a removeably attachable base wall. The removable base wall provides for a 'bottom entry' of the vial into the product cavity. Base wall would thus function as a bottom cap for the container. In one embodiment of the present invention, the base wall may define a portion of a cavity 116 which holds the vial 15 inserted in the product cavity. Once vial 15 is inserted into cavity 116, the clinician will be able to direct needles 125 and 135 through apertures 136 and 138 to withdraw the fluid contents from vial 15.

FIGS. 5 and 6 depict a radiation-shielding container 210 of the present invention. Container 210 is desirably identical to container 110, with like numbering reflecting like components, except for the modifications to accommodate the removable base portion as herein described. Container 210 includes a base 111, an upper cap 113, and inner cap 115. Additionally, base 111 includes removable base portion, or lower cap, 117. That is, for container 210, base shield 118 is a two-piece component as is base cover 145. For container 210, base 111 includes a cylindrical shield portion 118' and separable planar end wall portion 165'. Cover 145 includes a first portion 145*a* covering outer surface 146 of cylindrical shield portion 118' and a second portion 145*b* about outer surface 165*b* of end wall 165. Portions 145*a* and 145*b* include mating components 187 and 188, such as mating helical threads or bayonet connectors which allow for end wall portion 165' to be removably attached to cylindrical shield portion 118'. It will be understood that any interior liner 190 would likewise include a first portion 190*a* provided along surface 148 and a second portion 190*b* covering surface 165*a* as shown in FIG. 5. FIG. 6 does not depict the polymeric liners of FIG. 5, for clarity of the exploded view.

As previously described, upper cap 113 provides a shielding substrate 152 to be affixed to an inner surface 172*a* thereof. Shielding substrate 152 extends in overlying shielding registry with apertures 136 and 138 formed in shield 122 of inner cap 115 so as to guard against a shine path through those apertures from the product in container 15. Apertures 136 and 138 provide for insertion of cannulas 125 and 135 for withdrawing the product fluid from container 15 in cavity 166. The design and operation of container 210 will thus be understood to follow that of container 110 of the present invention, except as described herein.

Additionally, the present invention also contemplates, as best shown in FIG. 6, providing a semi-cylindrical wall 194 about container 15 within cavity 166 which extends substantially around the circumference of the vial. The semi-cylindrical wall 194 is desirably formed from a radiation-shielding material which itself is desirably coated with a polymeric coating (not shown) to protect a user handling wall 194. When the product vial is formed of a transparent material, the semi-cylindrical wall provides an elongate gap 195 along the length of the vial which will allow a clinician the ability to visually confirm the amount of fluid within the vial. Alternatively, the gap may allow a user to confirm information provided on a label attached to the vial. Desirably, semi-cylindrical wall 194 is affixed to base wall along a lower edge 194*a* so that the clinician may handle the rest of container 210 with one hand and the lower cap 117 with the other hand when removing the lower cap 117 from base 111 so as to inspect the product vial. Alternatively, semi-cylindrical wall may be affixed to shield 112, so that a clinician could inspect the vial by removing inner cap 115 from base 111. The present invention also contemplates that such an embodiment desirably includes a solid floor spanning lower edge 194*a* so as to hold vial 15 while the clinician lifts cap 115 and shield 194 from cavity 166. Thus, if the vial must be removed from the container, the exposure to the clinician may still be minimized. The thickness of the radiation shielding material in the semi-cylindrical wall 194, and the dimensions for container 210, may thus be selected according to the needs of the clinicians for a particular radioactive product fluid.

Figure 7:
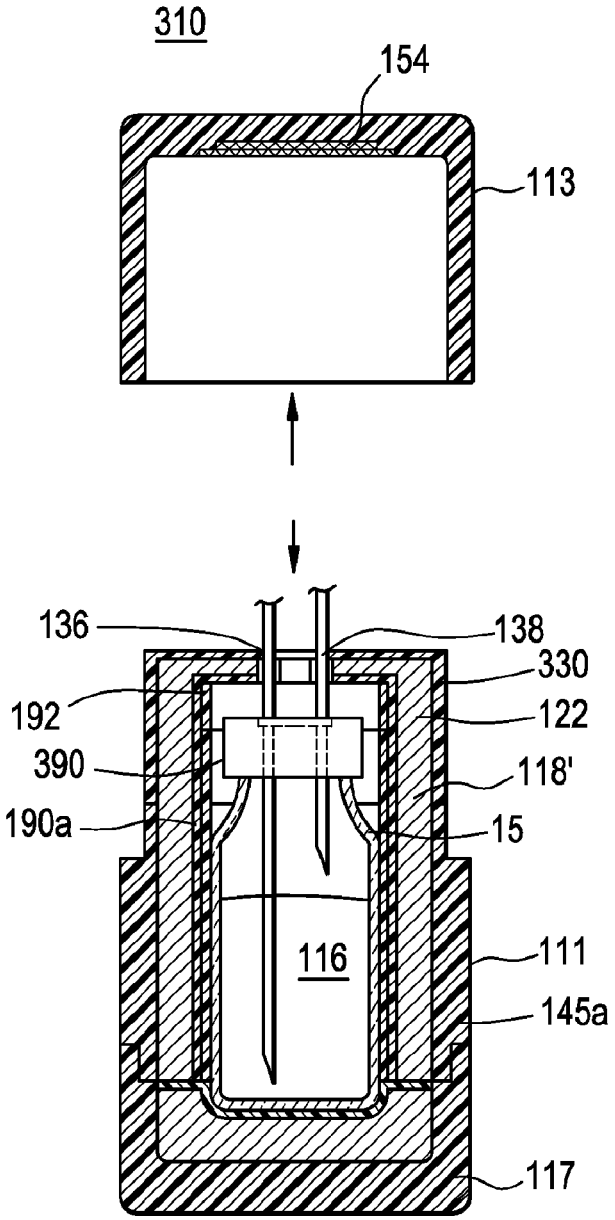
FIG. 7 depicts another embodiment of a radiation-shielding container of the present invention providing access to the cavity via the removable base portion.

FIG. 7 depict another container 310 of the present invention in which the inner cap shield is formed as a unitary piece with the cylindrical shield portion of the base shield while the planar base shield wall is detachable. That is, container 310 is a modification to container 210 in which shield 122 is formed as one piece with cylindrical shield portion 118' to form a unitary base shield. For container 310, base 111 may be said to define apertures 136 and 138 such that shielding substrate 154 of cap 113 is in overlying shielding registry therewith. Cavity 116 again provides a product vial 15 therein such that needles 125 and 135 may be inserted through passageways 136 and 138 so as to withdraw fluid from vial 15. Those of ordinary skill in the art will understand how liners 190*a* and 192 may also be formed as a unitary liner 390 and cover 145*a* may be formed with cover 130 as a unitary cover 330. Container 310 thus only provides a single entry for a vial 15 into cavity 166 by removing lower cap 117, inserting vial 15 into cavity 166 and then attaching lower cap 117 to the base 111 as described for FIGS. 5-6.

While the particular embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A radiation-shielding container for storing and transporting a radiopharmaceutical, said container comprising:

a base comprising an elongate cylindrical base shield having an open end defining a base aperture and an opposed closed end, said base shield including an outer base shield surface and an inner base shield surface, said inner base shield surface defining a base cavity in fluid communication with said base aperture;

an outer cap comprising an elongate cylindrical wall having a first open end and an opposed closed end, said outer cap defining an outer cap cavity, said outer cap and said base further including cooperating mating components to removeably secure said outer cap to said base;

an inner cap comprising an inner cap shield and a shield cover, said inner cap shield formed from a radiation-shielding material and including an elongate cylindrical inner shield wall having opposed first and second ends, said first end of said shield wall defining an inner cap shield aperture and said second end including a planar end wall spanning said cylindrical inner shield wall, said end wall including opposed first and second substantially planar surfaces, wherein said end wall defines at least one elongate open passageway opening on said first and second planar surfaces;

wherein said inner cap and said base further include cooperating mating members to removeably secure said inner cap to said base such that said inner cap is positioned within said outer cap cavity when said outer cap and said inner cap are secured to said base; and wherein said outer cap further comprises a planar shielding substrate formed from a radiation-shielding material supported by said outer cap in overlying shielding registry with said at least one passageway of said inner cap shield when said outer cap and said inner cap are secured to said base.

2. A radiation-shielding container of claim 1, wherein at least one of said inner cap shield and said base shield supports a polymeric protective liner such that no radiation-shielding material is exposed when the inner cap is assembled to said base.

3. A radiation-shielding container of claim 1, wherein said cap shield defines first and second elongate passageways therethrough.

4. A radiation-shielding container of claim 3, wherein said cap shield is covered by a polymeric liner along the outer surface.

5. A radiation-shielding container of claim 1, wherein said outer cap further includes a bonding layer, wherein said shielding substrate is affixed between said outer cap and said bonding layer.

6. A radiation-shielding container of claim 5, wherein said outer cap further comprises a planar end wall at said opposed closed end of said cylindrical outer cap wall, said end wall defining a recess into which said shielding substrate is supported.

7. A radiation-shielding container of claim 1, wherein both said outer cap and said base further comprise an outer liner about the outer surface of their respective shields, said outer liners providing mating engagement between said outer cap and said base.

8. A radiation-shielding container of claim 7, wherein both said outer cap and said base further comprise an inner liner along the inner surface of their respective shield surfaces.

9. A radiation-shielding container of claim 8, wherein said inner liner and said outer liner of both said outer cap and said base fully encapsulate their respective shields.

10. A radiation-shielding container of claim 1, further comprising a deflectable cushion supported within said base cavity.

11. A radiation-shielding container comprising:

a base;

an outer cap including an outer cap body defining an outer cap cavity and a shielding substrate formed from a radiation-shielding material;

an inner cap;

wherein said base and said inner cap are removably connectable to each other and include cooperating radiation shields defining a cavity therebetween for receiving a product container therein, said radiation shield of said inner cap defining at least one elongate passageway therethrough;

wherein said base and said outer cap are removably connectable to each other such that when said inner cap is connected to said base, said inner cap will be contained within said outer cap cavity and said at least one passageway extends in fluid communication between said cavity and said outer cap cavity; and wherein said shielding substrate of said outer cap is held in overlying shielding registry with said at least one passageway when said outer cap and said inner cap are connected to said base.

12. A radiation-shielding container of claim 11, wherein said outer cap further comprises a bonding layer, wherein said shielding substrate is held between said outer cap substrate and said outer cap body.

13. A radiation-shielding container of claim 11, further comprising a polymeric liner positioned about said radiation shield of said base such that no radiation-shielding material is exposed.

14. A radiation-shielding container of claim 11, further comprising a polymeric liner positioned about said radiation shield of said inner cap such that no radiation-shielding material of said inner cap is exposed.

15. A radiation-shielding container of claim 11, further comprising a first polymeric liner positioned about said radiation shield of said base and a second polymeric liner positioned about said radiation shield of said inner cap such that no radiation-shielding material of said inner cap or said base is exposed when said inner cap is removeably connected to said base.

16. A radiation-shielding container of claim 11, wherein said outer cap body is formed from a polymeric material.

17. A radiation-shielding container of claim 11, wherein said outer cap body and said base include cooperating helical threads to removably connect said outer cap body to said base.

18. A radiation-shielding container of claim 11, wherein said outer cap body and said base include cooperating bayonet connectors to removably connect said outer cap body to said base.

19. A radiation-shielding container of claim 11, wherein said inner cap and said base include cooperating helical threads to removably connect said outer cap body to said base.

20. A radiation-shielding container of claim 11, wherein said outer cap body and said base include cooperating deflectable detents to removably connect said outer cap body to said base.

21. A radiation-shielding container comprising:

a base defining a cavity for receiving a product fluid container holding a product fluid, the product fluid container including a pierceable septum covering an open end thereof, the base defining an aperture therethrough in fluid communication with said cavity so as to be in overlying registry with the septum of the product fluid container, the base further comprising a removable lower cap;

an outer cap including an outer cap body defining an outer cap cavity and a shielding substrate formed from a radiation-shielding material;

a lower cap;

wherein said base and said lower cap are removably connectable to each other and include cooperating radiation shields defining a cavity therebetween for receiving the product fluid container therein, a radiation shield of an inner cap defining at least one elongate passageway therethrough;

wherein said base and said outer cap are removably connectable to each other; and Wherein said shielding substrate of said outer cap is held in overlying shielding registry with said at least one passageway of said inner cap when said outer cap and said base are connected together.

22. A radiation-shielding container of claim 21, wherein said at least one passageway extends in fluid communication between said cavity and said outer cap cavity when said outer cap and said base are connected together.

* * * * *